US005873805A

United States Patent [19]

Ayres et al.

[11] Patent Number: 5,873,805

[45] Date of Patent: Feb. 23, 1999

[54] WRIST EXERCISE DEVICE

[75] Inventors: Keith B. Ayres, Canyon Lake; James R. Ayres, Menifee, both of Calif.

[73] Assignee: R & I Industries, Inc., Ontario, Calif.

[21] Appl. No.: 957,247

[22] Filed: Oct. 24, 1997

[51] Int. Cl.[6] ..... A63B 21/02

[52] U.S. Cl. ..... 482/125; 482/122; 482/124

[58] Field of Search ..... 482/44, 46, 121, 482/122, 124, 125

[56] References Cited

U.S. PATENT DOCUMENTS

| | | | |
|---|---|---|---|
| 843,478 | 2/1907 | Müller . | |
| 1,980,861 | 11/1934 | Hunter . | |
| 2,160,722 | 5/1939 | Cunningham . | |
| 3,498,609 | 3/1970 | Lukens . | |
| 4,019,734 | 4/1977 | Lee et al. . | |
| 4,059,265 | 11/1977 | Wieder et al. . | |
| 4,195,835 | 4/1980 | Hinds et al. . | |
| 4,245,840 | 1/1981 | Van Housen . | |
| 4,685,671 | 8/1987 | Hagerman et al. . | |
| 5,125,649 | 6/1992 | Fuller . | |
| 5,336,151 | 8/1994 | Van Ballegooie . | |
| 5,372,565 | 12/1994 | Burdenko . | |
| 5,518,480 | 5/1996 | Frappier | 482/124 |
| 5,549,532 | 8/1996 | Kropp . | |
| 5,558,609 | 9/1996 | Olschansky et al. | 482/125 |

*Primary Examiner*—Lynne A. Reichard
*Attorney, Agent, or Firm*—Cislo & Thomas LLP

[57] ABSTRACT

A wrist exercise device has a tube-like handle with rubber grips proximate each end. Resistive tubing is attached to the center of the handle at one end of the tubing, and is attached to a strap at the other end of the tubing. The attachment to the handle is made by an aperture in the handle through which an end of the tubing is passed, and a ball is friction fit into that end of the tubing. The tubing is similarly connected to the strap by forming an aperture in the strap, reinforced by a grommet, and friction fitting a ball into the end of the tubing which is passing through the strap. An exerciser uses the device by anchoring it by passing, for example, a foot through the strap or holding the strap and by pulling or rotating or otherwise moving the handle against the resistance of the resistive tubing. Resistance may be increased by winding the tubing around the handle a desired amount.

15 Claims, 3 Drawing Sheets

FIG. 1
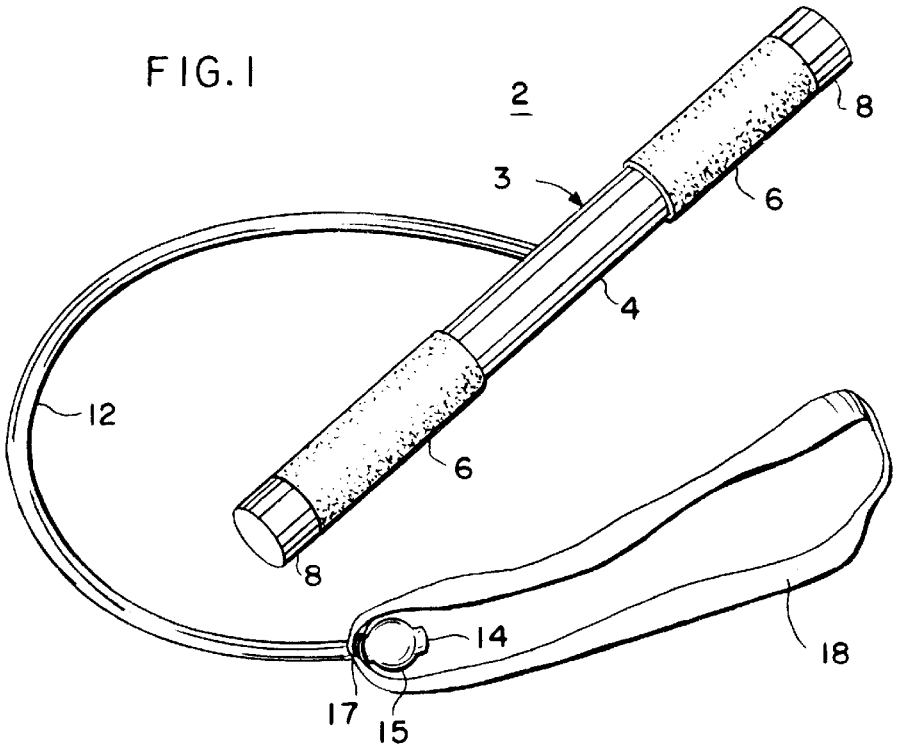
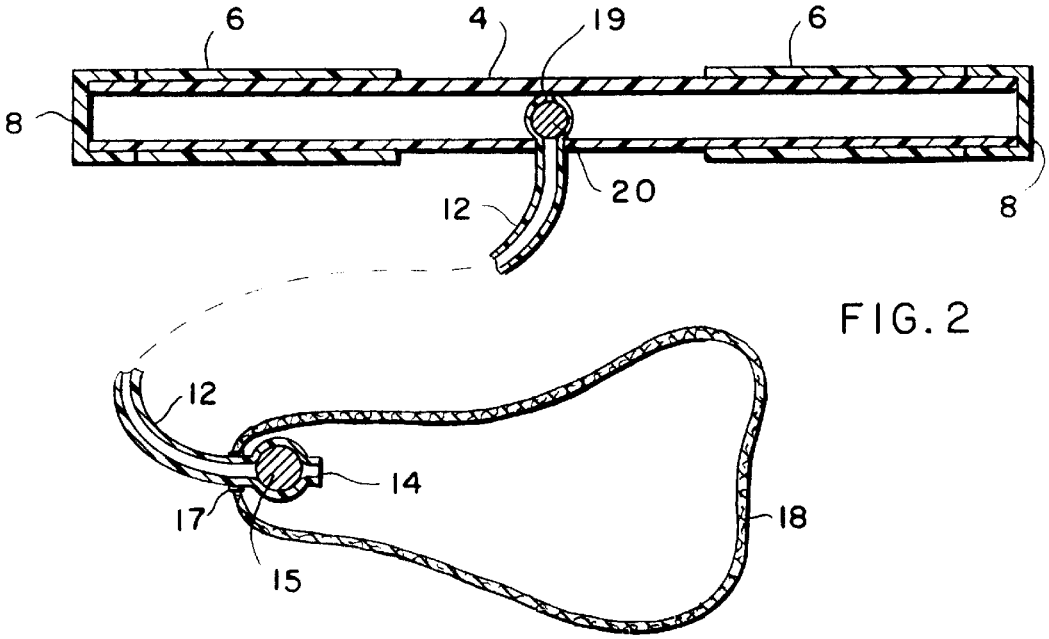
FIG. 2

WRIST EXERCISE DEVICE

BACKGROUND OF THE INVENTION

1. Field of the Invention

The present invention relates to a unique wrist exercise device.

2. Description of the Related Art

There are many wrist exercise devices. In patents to Kropp (U.S. Pat. No. 5,549,532 issued Nov. 13, 1934), Hinds et al. (U.S. Pat. No. 4,195,835 issued Apr. 1, 1980), and Wieder et al. (U.S. Pat. No. 4,059,265 issued Nov. 22, 1977), the emphasis is on exercising the arms and legs by resistant bands. All of these inventions generally use dual straps or one strap doubled back in order to provide balanced exercise for the arms and legs.

In a patent to Hunter (U.S. Pat. No. 1,980,861 issued Nov. 13, 1934), an exercise apparatus provides a center resistive device but no resistance is provided by handle 28 to the wrists or the forearms. The Hunter device is one to exercise the arms and legs and not the wrists.

Most wrist exercise devices are directed to exercising the larger muscle groups and not the tendons, ligaments, and muscles of the forearm and wrist area.

What is needed is a device to exercise both wrists simultaneously and to develop tendons, ligaments, and muscles. What is also needed is such an exercise device which is simple to use, simple in construction, inexpensive, lightweight and reliable.

SUMMARY OF THE INVENTION

In one embodiment of the invention, a wrist exercise device has a main handle formed by a hollow tube. At each end of the main handle are rubber grips. Rubber caps seal the open ends of the main handle. A resistive cord or strap, such as provided by surgical tubing, is attached to the main handle. Both ends of the tubing are secured by insertion of balls, e.g., of wood or metal, friction fit within the tubing. The handle has a central aperture through which one end of the resistive tubing fits, and the ball is then inserted into that end of the tubing. At the opposite end of the resistive strap from the handle, a nylon strap provides a stirrup or other fixed point against which the main handle can be pulled. The stirrup has a grommet of brass or the like through which the end of the resistive tube extends and then is secured by the ball friction fit within it.

In a preferred embodiment, the handle is approximately one and one-half (1½) feet long, and the resistive tubing is about two (2) feet long and the nylon strap is about two and one-half (2½) feet long. The lengths may be selected to provide optimum exercise advantage. The grips would preferably extend five (5) inches.

Numerous exercises are possible with this simple device. By placing one foot through the non-elastic nylon strap, the main handle may be gripped and stretched in order to provide resistance against motion of the main handle. The main handle can then be rotated or articulated by the wrists in order to strengthen them. Additional exercises may be provided by holding the main handle and lifting the legs, moving the arms, and other body motion. In addition, the handle can be held in one arm and the strap in the other, or one can even sit or stand on the handles, which provide different positions for different exercises. The resistance may be adjusted by wrapping the resistive tubing around the handle.

BRIEF DESCRIPTION OF THE DRAWINGS

FIG. 1 is a perspective view of the exercise device according to the invention;

FIG. 2 is a sectional view of the device of FIG. 1 showing connections of the main handle and strap to the resistive tubing.

DESCRIPTION OF THE PREFERRED EMBODIMENT(S)

Figure 3:
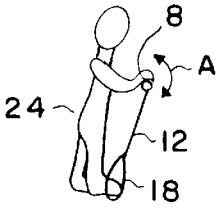
FIGS. 3–20 are drawings showing a person performing various exercises using the exercise device according to the invention.

A wrist exercise device is shown in FIG. 1. Exercise device 2 has a main handle 3 formed by a tube 4. Wrist grips 6 are proximate each end of the handle and end caps 8 are placed over the open ends of the tube 4. Resistive tubing 12 provides resistance to movement of the handle. The resistive tubing 12 is attached at one end to the center of the handle and at the other end to a nylon strap 18. As best shown in the sectional view of FIG. 2, resistive tubing 12 attaches to handle 3 by passing through an aperture in tube 4, and a ball 20 is friction fit within the tubing 12. The end 19 of the tubing may be sealed, although the friction between the ball and tubing should be sufficient to keep the ball within the tube. At the other end 14 of the tubing 12, another ball 15 holds that end to a strap 18 which may be adjustable. A grommet 17 sewn, e.g., in a bridge-like fashion, or otherwise fixed to the strap 18 provides reinforcement to the strap where the tubing passes through it. This end 14 of the tubing may also be sealed, although friction between the ball and tubing should be sufficient to hold it.

Preferably tubing 12 and apertures within the tube 4 and grommet 17 are about three-eighths inch (⅜") and the balls are about one-half inch (½") and may be made of wood or metal. Tube 4 of handle 3 is preferably made of PVC, such as schedule 80 PVC, end caps 8 are preferably of rubber, and grips 6 are also preferably of rubber with a textured surface. Strap 18 is preferably nylon. The length of the handle is preferably about eighteen inches (18") and the length of the tubing 12 is preferably about twenty-four inches (24"). The strap is preferably about thirty inches (30").

The tubing 12 is a resistive tubing, such as surgical tubing, other rubber, or the like, which provides some resistance to rotation of the handle about any axis, as well as lateral motion of the handle especially in directions which stretch the tubing.

In use, the exerciser uses the nylon strap as an anchor by putting one or both feet through it and holds on to the handle with one hand at the center or both hands on the opposite grips. The exerciser can exercise the wrists by rotating the handle about its own axis. Other ways to hold the device are illustrated in FIGS. 3–20.

FIGS. 3–20 show some of the variety of exercises which may be done with the subject invention.

FIG. 3 shows wrist and forearm curls. The exercising person 24 puts either foot, such as the right foot, through strap 18 to anchor the device, or both feet may be placed in the strap. The handle 3 is held substantially horizontal and the hands are on the grips with palms facing down. The exerciser bends his or her arms at the sides and holds hands out front. The handle is rolled towards the exerciser and then away. This is done by rolling the wrists (wrist curls) or bending the arms (forearm curls) and moving them back and forth in the direction of the curved arrow A which wraps the tubing around the handle.

Figure 4:
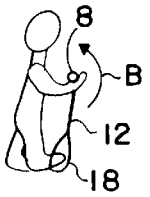

FIG. 4 shows biceps curls. The positioning is similar to that of FIG. 3 except that the exerciser grabs the handle with palms facing upward. The handle is moved back and forth in the direction of the curved arrow B to bring it up from hips to shoulders and back.

Figure 5:
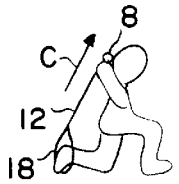

FIG. 5 shows triceps extensions. The exerciser 24 kneels with feet behind and one or both feet in the strap. It should be noted that if kneeling to perform the triceps or shoulder press, as shown in the drawings, the user may kneel on one foot with the other foot being forward. The handle is held horizontal behind and at the exerciser's head with palms facing substantially upward. The elbows are held stationary next to the head and the handle is moved up and down in a direction of arrow C above the exerciser's head by moving the forearms.

Figure 6:
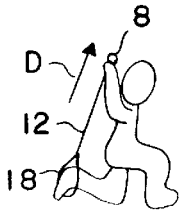

FIG. 6 shows a shoulder press. Positioning is the same as in the triceps extensions except that the elbows are not held stationary. The arms and elbows may be moved to press the handle overhead in the direction of arrow D. The pushing motion should be substantially straight up. One can also be seated in a chair while doing this exercise.

Figure 7:
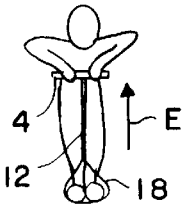

FIG. 7 shows an upright row. The user has both feet in the strap, grabs the handle with palms facing down and the bar horizontal about the user's chest. The user brings the handle to the chin by moving it in the direction of arrow E.

Figure 8:
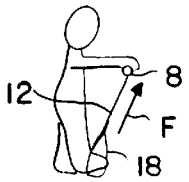

FIG. 8 shows a front deltoid raise. The user stands with both feet in the strap, grabs the handle with palms down and arms straight out in front with the handle horizontal. The user brings the handle to about chin height.

Figure 9:
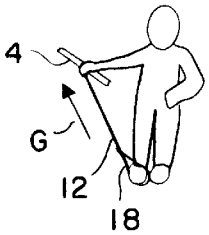

FIG. 9 shows a side lateral raise. One foot is placed in the strap and the arm on that side of the body is positioned straight and out to the side. The hand grips the handle at the center with palm down. The arm is then rotated upward in the direction of arrow G. The exercise is performed one side at a time.

Figure 10:
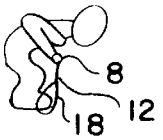

FIG. 10 illustrates a rear deltoid raise. One foot is placed in the strap and the handle is grabbed with one hand at the center, palms downward. The exerciser bends forward at the waist so that the upper body is parallel with the ground. The handle is raised by moving the arm backward and upward to the height of the back. The arm is held out and raised so that it will be approximately in line with the shoulders.

Figure 11:
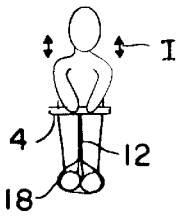

FIG. 11 shows a shoulder shrug. Both feet are placed in the strap and the handle is grabbed with the palms down. The arms are straight and the shoulders are raised in the direction of the arrows I.

Figure 12:
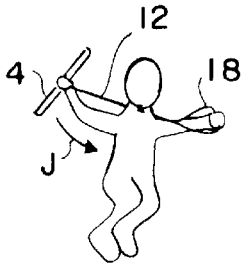

FIG. 12 shows a chest fly. The strap is grabbed with one hand and the arm which grasps the strap is held straight out to the side. The other hand grasps the handle at the center, palm up, and that arm is also held straight out to the side. The tubing is behind the exerciser. This exercise is best performed while lying on one's back, with the elbow (for the strap hand) against the ground and the other arm straight up. Bring the handle toward the strap hand until the knuckles touch and then back as shown by arrow J.

Figure 13:
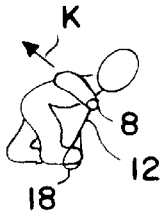

FIG. 13 illustrates bent over rows and one arm rows. For bent over rows, the exerciser puts both feet or one foot in the strap. The handle is grabbed with both hands, palms down. The exerciser bends at the waist so that the upper torso is parallel to the ground and the handle is brought to the chest and back in the direction of arrow K. For one arm rows, the handle is grabbed palm down at the center, and the exercise is otherwise the same.

Figure 14:
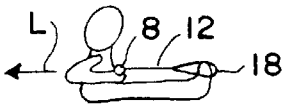

FIG. 14 shows seated rows. The exerciser sits on the floor with both feet in the strap and extended. The exerciser grabs the handle with palms down. The knees are slightly bent. The exerciser brings the handle towards the lower rib cage in the direction of arrow L and back.

Figure 15:
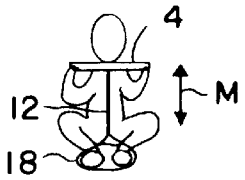

FIG. 15 shows squats. The exerciser squats with both feet in the strap and both hands on the handle either palms up or down. The handle is behind the exerciser's head and the exerciser bends at the knees. The exerciser stands and squats which moves the handle in the direction of arrow M without moving the arms.

Figure 16:
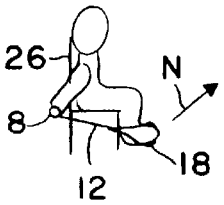

FIG. 16 shows leg extensions. The exerciser sits in a chair 26 with both feet or just one foot in the strap. The resistive tube runs between the legs and the exerciser sits on it, with the handle being behind the exerciser's back. The exerciser then lifts one or two legs, whichever number are through the strap in the direction of arrow N. The exercise works best with an open-back chair so that the exerciser can hold the bar behind chair 26 as shown in the drawing.

Figure 17:
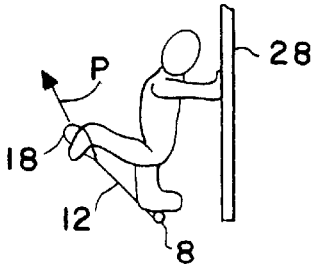

FIG. 17 shows a standing leg curl. Preferably, the exerciser has arms outstretched in front and braced against a wall 28. The exerciser puts one foot through the strap. The other foot stands on top of the handle. The exerciser then lifts his leg behind him bending at the knee to move the strap in the direction of arrow P and back. Instead of a wall, the exerciser can brace himself against a chair or other object. The strap should be around the heel of the foot being lifted.

Figure 18:
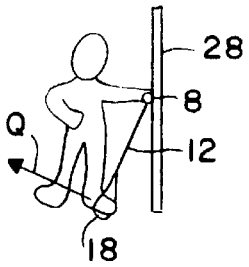

FIG. 18 shows inner or outer thigh exercises. Preferably, the exerciser stands with one arm outstretched and braced against wall 28. The outstretched arm holds the handle palm down and preferably at the center. The exerciser is standing sideways to the wall and with one leg slightly forward of the other and through the strap. The leg is rotated from the hip toward or away from the wall and back in the direction of curved arrow Q.

Figure 19:
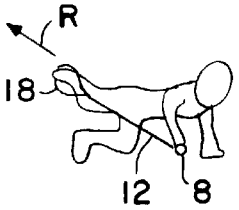

FIG. 19 shows an exercise for the gluteus maximus. The exerciser kneels on the floor and also leans forward with arms outstretched and pressed against the floor. The handle is held palms downward. The tube is run through the legs and the strap is hooked around the heel of the leg to be exercised. The exerciser then lifts the leg upwards and may also slightly straighten the leg as shown generally by arrow R.

Figure 20:
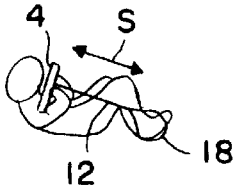

FIG. 20 shows abdominal crunch exercises. The user lies down with back on the floor and knees up. The exerciser places one or both feet through the strap and the resistive tubing extends through the exerciser's legs. The handle is held across the chest with arms crossed so that they hold the opposite ends. The exerciser then performs an abdominal crunch or may move the knees toward the chest moving the tubing in the direction of arrow S.

Many other exercises are possible. A rotator cuff exercise may also be done as well as four-way neck movements. In the rotator cuff exercise, internal or external rotation movements may be performed.

The user can control the amount of resistance exerted by the resistive tubing by turning the handle to take up some of the slack of the tubing and provide additional resistance.

The device assists in the development of tendons, ligaments and muscles particularly in the forearm and wrist areas. However, it is also a great way to localize circulation, increase strength in the wrist flexors and the wrist extensors, and is beneficial to the biceps, triceps, legs, back, deltoids and many other areas of the body. It is lightweight, durable, inexpensive and easy to manufacture and store. It is ideal for those who require wrist strength and endurance, such as computer users and athletes, for example, golfers, baseball players, hockey players, tennis players, volleyball players, racquetball players, water skiers and the like.

While the present invention has been described with regards to particular embodiments, it is recognized that additional variations of the present invention may be devised without departing from the inventive concept.

What is claimed is:

1. An exercise device comprising:

a handle having an elongate shape for gripping at each end;

an elongate resistive element for providing resistance to motion of the handle, the resistive element comprising a single resistive tube having first and second ends;

means for anchoring the resistive element comprising a strap forming a single non-elastic flexible closed loop;

first means for attaching the first end of the resistive element directly to the handle; and second means for attaching the second end of the resistive element directly to the means for anchoring, wherein the handle is rigid and the resistive element attaches to the handle proximate a central point on the handle, wherein the first means for fastening the resistive element comprises an aperture defined in the handle through which the resistive element is disposed, and a ball having a diameter greater than a diameter of the aperture friction fit into the first end of the resistive element, and wherein the second means for fastening comprises an aperture defined in the strap and a ball having a diameter greater than the diameter of the aperture friction fit into the second end of the resistive element.

2. The exercise device of claim 1 wherein the strap is continuous.

3. The exercise device of claim 1 wherein the handle has means for gripping disposed proximate each end thereof.

4. The wrist exercise device of claim 1 wherein the second means for fastening further comprises a grommet fastened to the strap for reinforcing the strap at the periphery of the aperture.

5. The exercise device of claim 2 wherein the strap is nylon, the handle comprises a PVC tube, and the resistive element is rubber tubing.

6. The wrist exercise device of claim 1 wherein the resistive element comprises surgical tubing.

7. The wrist exercise device of claim 1 wherein the handle is about eighteen inches (18") long, the resistive element is about twenty-four inches (24") long and the strap is about thirty inches (30") long.

8. The exercise device of claim 1 wherein and the handle is adapted for having the tube wrapped around it a desired number of times to adjust the length between the strap and handle to adjust the amount of resistance provided by the resistive element to a given range of motion of the handle relative to the strap.

9. An exercise device comprising:

a rigid plastic handle having an elongate shape and having means for gripping disposed proximate first and second ends thereof;

a single elongate resistive tubing having first and second ends for providing resistance to motion of the handle;

a flexible strap for anchoring the resistive tubing the strap forming a single non-elastic closed loop;

first means for fastening the first end of the resistive tubing directly to a center of the handle; and second means for fastening the second end of the tubing directly to the strap.

10. The exercise device of claim 9 wherein the first means for fastening comprises an aperture defined in the handle through which the first end of the tubing is disposed, and a ball having a diameter greater than a diameter of the aperture friction fit into the first end of the tubing.

11. The wrist exercise device of claim 9 wherein the second means for fastening comprises an aperture defined in the strap through which the second end of the tubing is disposed and a ball having a diameter greater than the diameter of the aperture friction fit into the second end of the tubing.

12. The wrist exercise device of claim 11 wherein the second means for fastening further comprises a grommet fastened to the strap for reinforcing the strap at the periphery of the aperture.

13. The wrist exercise device of claim 9 wherein the strap is formed of nylon, wherein the resistive tubing comprises surgical tubing, and the handle comprises PVC.

14. The exercise device of claim 9 wherein the handle is about eighteen inches (18") long, the resistive tubing is about twenty-four inches (24") long and the strap is about thirty inches (30") long.

15. The wrist exercise device of claim 9 wherein the handle is adapted for having the tubing wrapped around it a desired number of times to adjust the length between the strap and tubing and to adjust the amount of resistance provided by the resistive element for a given range of motion of the handle relative to the strap.

* * * * *